US007259775B2

(12) United States Patent
Yoshida

(10) Patent No.: US 7,259,775 B2
(45) Date of Patent: Aug. 21, 2007

(54) IMAGE RECORDING APPARATUS

(76) Inventor: Naoki Yoshida, c/o WEDG Co., Ltd., Minami Ohtsuka Arrow Bldg., 7F, 3-30-3, Minami Ohtsuka, Toshima-ku, Tokyo (JP)

( * ) Notice: Subject to any disclaimer, the term of this patent is extended or adjusted under 35 U.S.C. 154(b) by 282 days.

(21) Appl. No.: 11/092,740

(22) Filed: Mar. 30, 2005

(65) Prior Publication Data

US 2005/0219347 A1 Oct. 6, 2005

(30) Foreign Application Priority Data

Mar. 31, 2004 (JP) ..... 2004-107990

(51) Int. Cl.
*B41J 2/00* (2006.01)

(52) U.S. Cl. ..... 347/196

(58) Field of Classification Search ..... 347/183, 347/188, 191, 192, 194, 195, 196
See application file for complete search history.

(56) References Cited

FOREIGN PATENT DOCUMENTS

GB 2 227 392 A * 7/1990

* cited by examiner

*Primary Examiner*—K. Feggins
(74) *Attorney, Agent, or Firm*—Bacon & Thomas, PLLC

(57) ABSTRACT

A small-size color printer which can perform printing while generation of wrinkles is prevented in an ink ribbon to suppress decrease in print quality caused by the wrinkles of the ink ribbon is provided. A status of image data in a print area is determined, and print pulses are also applied to white portions in which energy is not applied in the conventional method. The print pulse has the highest energy in which coloring is not generated. Therefore, distortion caused by the thermal difference in the ink ribbon is reduced in the print area, which allows the decrease in print quality caused by the wrinkles of the ink ribbon to be suppressed.

3 Claims, 12 Drawing Sheets

INK-RIBBON IS STRETCHED BY APPLYING PSEUDO-CONDUCTING PULSE, DIFFERENCE IN STRETCH BETWEEN COLORING PORTION AND NON-COLORING PORTION IS REDUCED, WHICH ALLOWS WRINKLE TO BE HARDLY GENERATED

PRINT STATUS

GENERATION OF WRINKLE IS NOT OBSERVED

IMAGE RECORDING APPARATUS

BACKGROUND OF THE INVENTION

1. Field of the Invention

The prevent invention relates to an image recording apparatus in which an image is formed by transferring a coloring material to a recording medium with a thermal head, particularly to the image recording apparatus which can perform high-speed printing.

2. Description of the Related Art

Recently, needs for print outputs of color digital images are grown as digital cameras widely spread. Various methods of printing the color digital image are proposed. For example, in a thermal transfer type printers with a thermal head such as a sublimation type printer, printing expression equivalent to a silver salt type print can be obtained by gray scale. Further, in the thermal transfer type printer, miniaturization can be achieved because solutions such as chemicals are not used, so that the thermal transfer type printer receives wide spread attention as the printer which has a potential for replacing the silver salt photograph at home.

FIG. 2 shows the conventional thermal head conducting control method. In the conducting method shown in FIG. 2, elements of the thermal head are heated by selectively passing current through the elements according to inputted image data, an ink ribbon is heated, and ink is transferred to the recording medium to form the image. At this point, for example in the case of 8 bits and 256-level gradation according the image data, coloring density varies in 256 levels by an energy varying method such as thermal head conduction time sharing and shading is applied, which results in the print having the photograph-like gradation. In this case, the image data varies from a 0 level to a 255 level. A 0-level gradation represents a white color. In the 0-level portion, it is determined that the image data does not exist. In a 255-level portion, it is determined that the image data represents the maximum density. In the case where the image data is the 0-level gradation, since the image data represents the white color, the current is not passed through the thermal head. On the other hand, the 255-level portion is maximum density, appropriate conducting pulses are applied to the thermal head, and thermal energy is conducted to the ink ribbon. Accordingly, the amount of transfer ink applied on the ink ribbon is controlled by changing the energy of the conducting pulses from the 1 level to the 255 level, and the image is formed in the recording medium which is of an image receiving member.

In the case where the image data is the 0-level gradation, since the image data represents the white color, the current is not passed through the thermal head. The 255-level portion is a maximum density portion, the appropriate conducting pulses are applied to the thermal head, and the thermal energy is conducted to the ink ribbon. Therefore, the amount of transfer ink applied on the ink ribbon is controlled by changing the energy of the conducting pulses from the 1 level to the 255 level except 0-level gradation, and the image is formed in the recording medium which is of an image receiving member. The amount of transfer ink varies according to the thermal energy given to the ink ribbon. At the same time, a base film of the ink ribbon is also stretched by the heat, and the base film is stretched. For example, when an image shown in FIG. 4 is printed, the 0-level portion which is of the non-conducting portion differs from the 255-level portion which is of the conducting portion in the stretch of the ink ribbon. Accordingly, the distortion shown in FIG. 5 is generated, and wrinkles tend to be generated in the ink ribbon by the difference in stretch. When the image is formed in the image receiving member, since the ink is not normally transferred in the wrinkle portion, the traces shown in FIG. 6 appears in the print, and the normal print is not performed. Particularly, in the case where the print is performed in a short time, the tendency is enhanced because it is necessary to apply the high energy in a short time, which results in ribbon wrinkle. The ribbon wrinkle seriously affects on quality of the print image. Therefore, in order to shorten the print time, it is necessary that the distortion is reduced.

In order to solve the ribbon-wrinkle problem, the method in which the conduction is performed to dots in a margin located outside the print area is proposed. However, the method cannot be provided for a frameless print (print without a margin) (for example, see Japanese Patent Application Laid-Open No. 11-301005).

SUMMARY OF THE INVENTION

In order to solve the above problem, in a thermal head conducting control method according to the invention, the conducting pulses having the largest energy in which the coloring is not generated according a setting parameter are applied to the 0-level portion where originally the conduction is not performed due to the absence of the image data in at least the print area. Therefore, the ribbon wrinkle is reduced by decreasing the distortion caused by the difference in thermal affection to the ink ribbon between the coloring portions having image data of at least the 1-level gradation and the white portions having image data of the 0-level gradation. Therefore, in any print image data, the smooth image print can be realized with no wrinkle, and the distortion caused by the heat of the ink ribbon is reduced, so that the energy can further be applied to achieve speedup of the printing.

DESCRIPTION OF THE PREFERRED EMBODIMENT

Referring to the accompanying drawings, an image recording apparatus according to a preferred embodiment of the invention will be described below.

Figure 1:
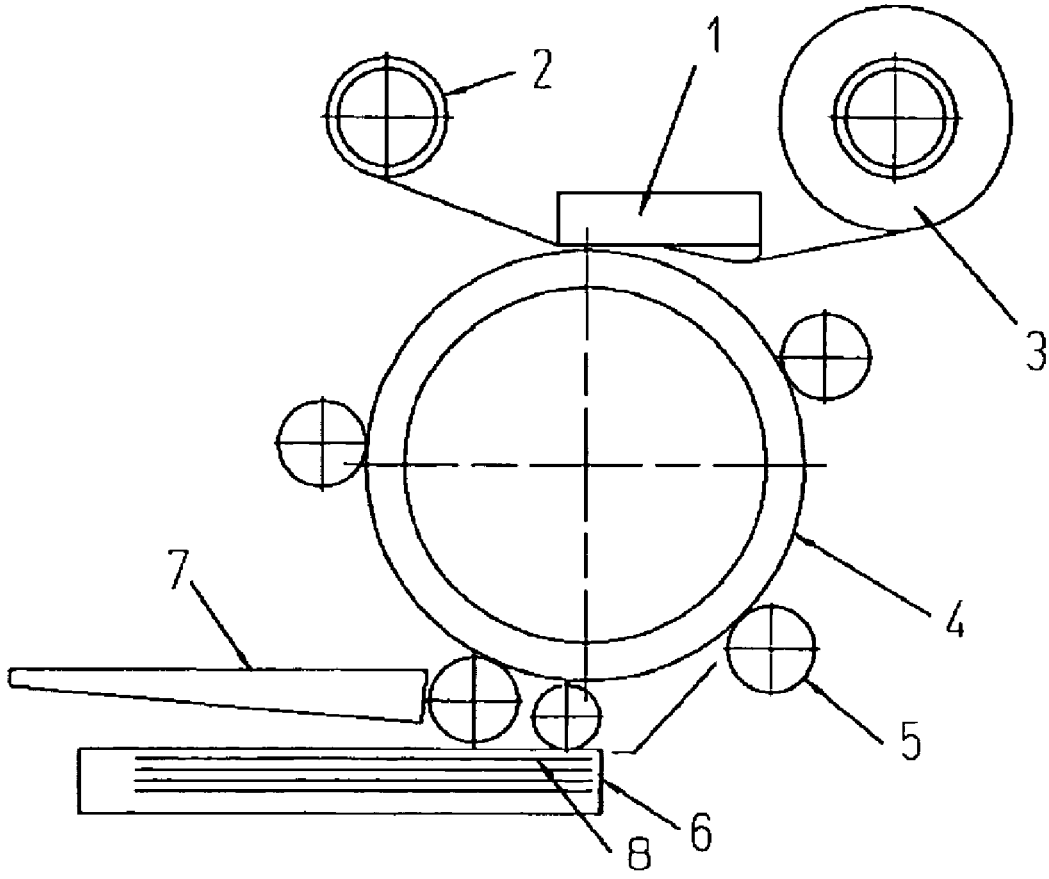
FIG. 1 is a schematic view showing an image recording apparatus in the conventional method.

FIG. 1 is a schematic view showing an image recording apparatus according to the invention.

Figure 2:
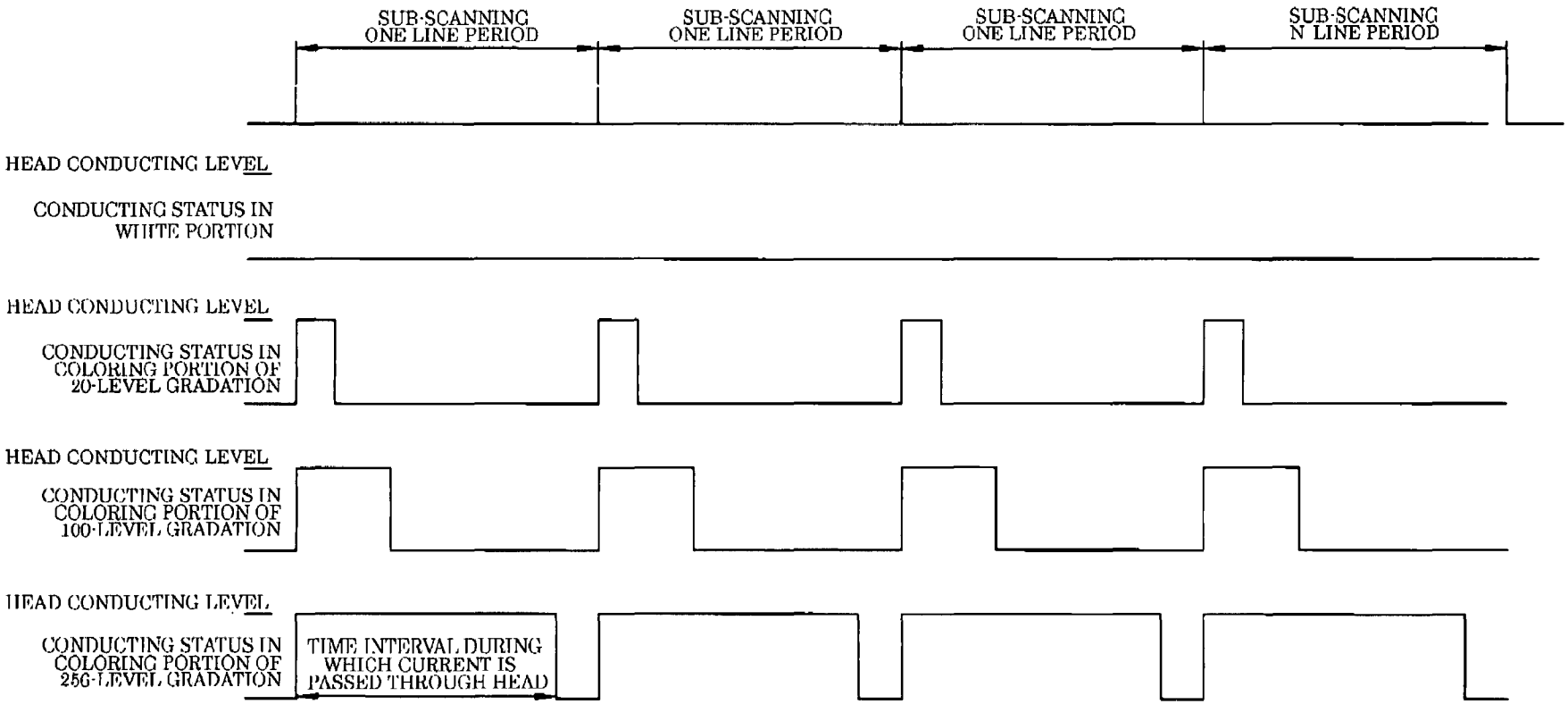
FIG. 2 is a graph showing a conducting status in the conventional method.
Figure 3:
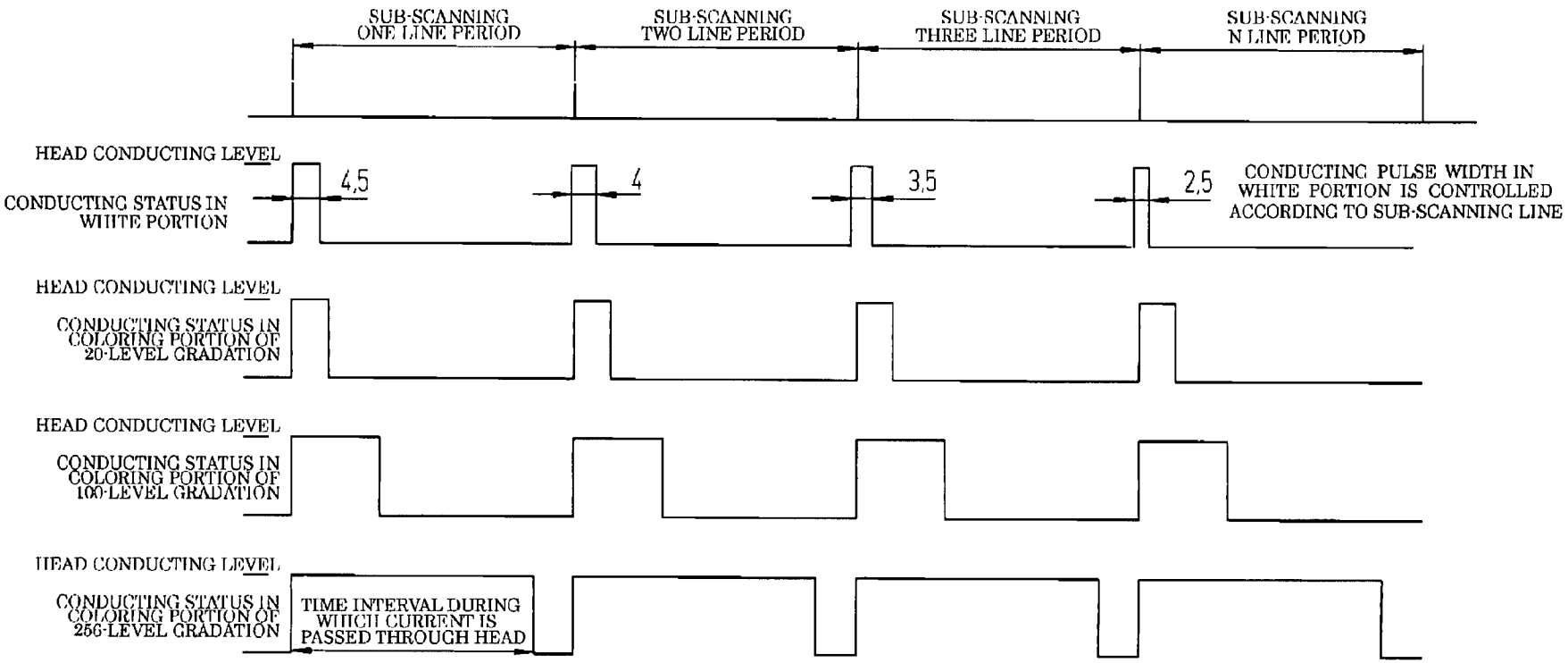
FIG. 3 is a graph showing the conducting status in the image recording apparatus according to the invention.
Figure 4:
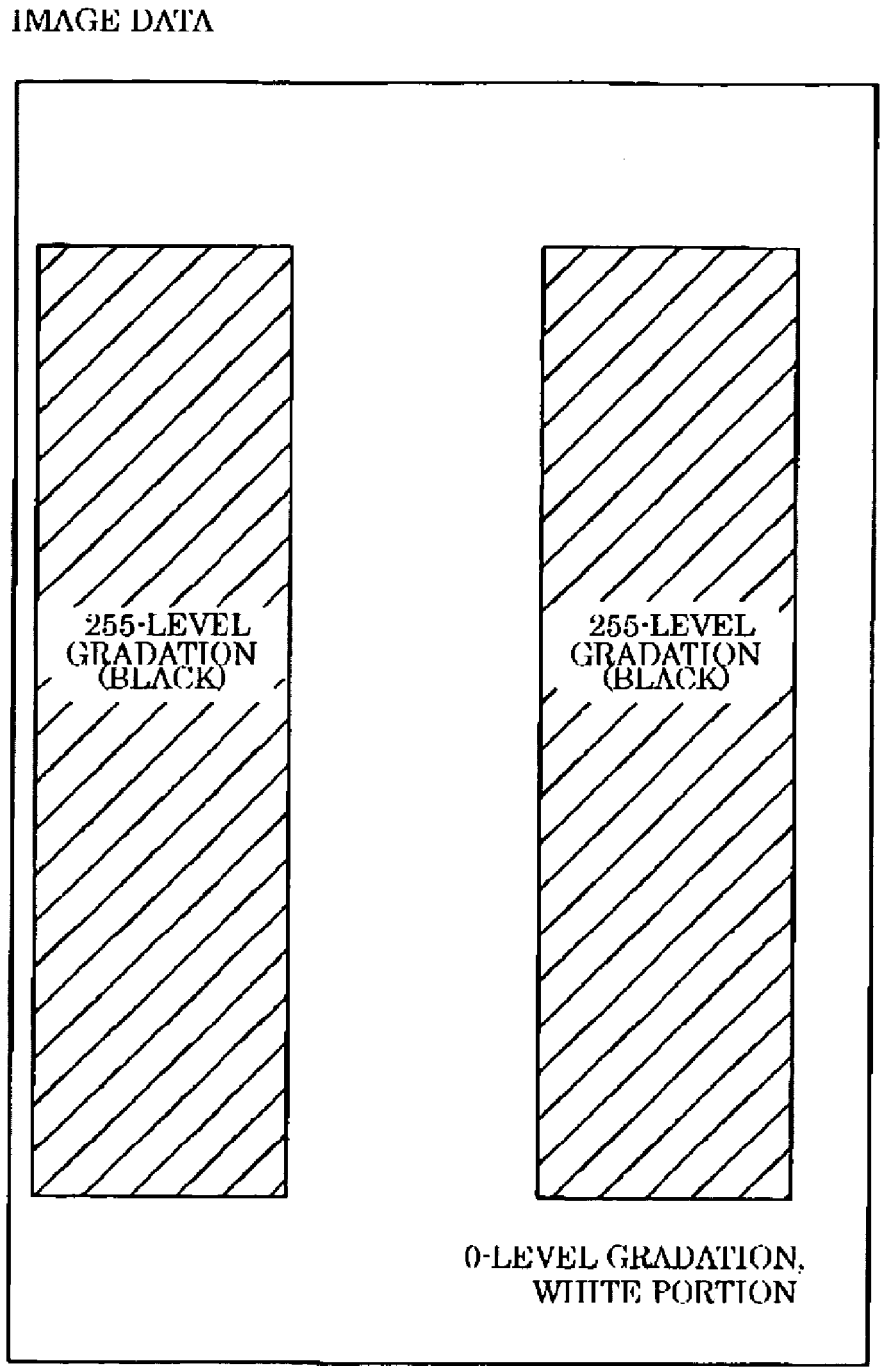
FIG. 4 is an explanatory view showing an example of print data.
Figure 5:
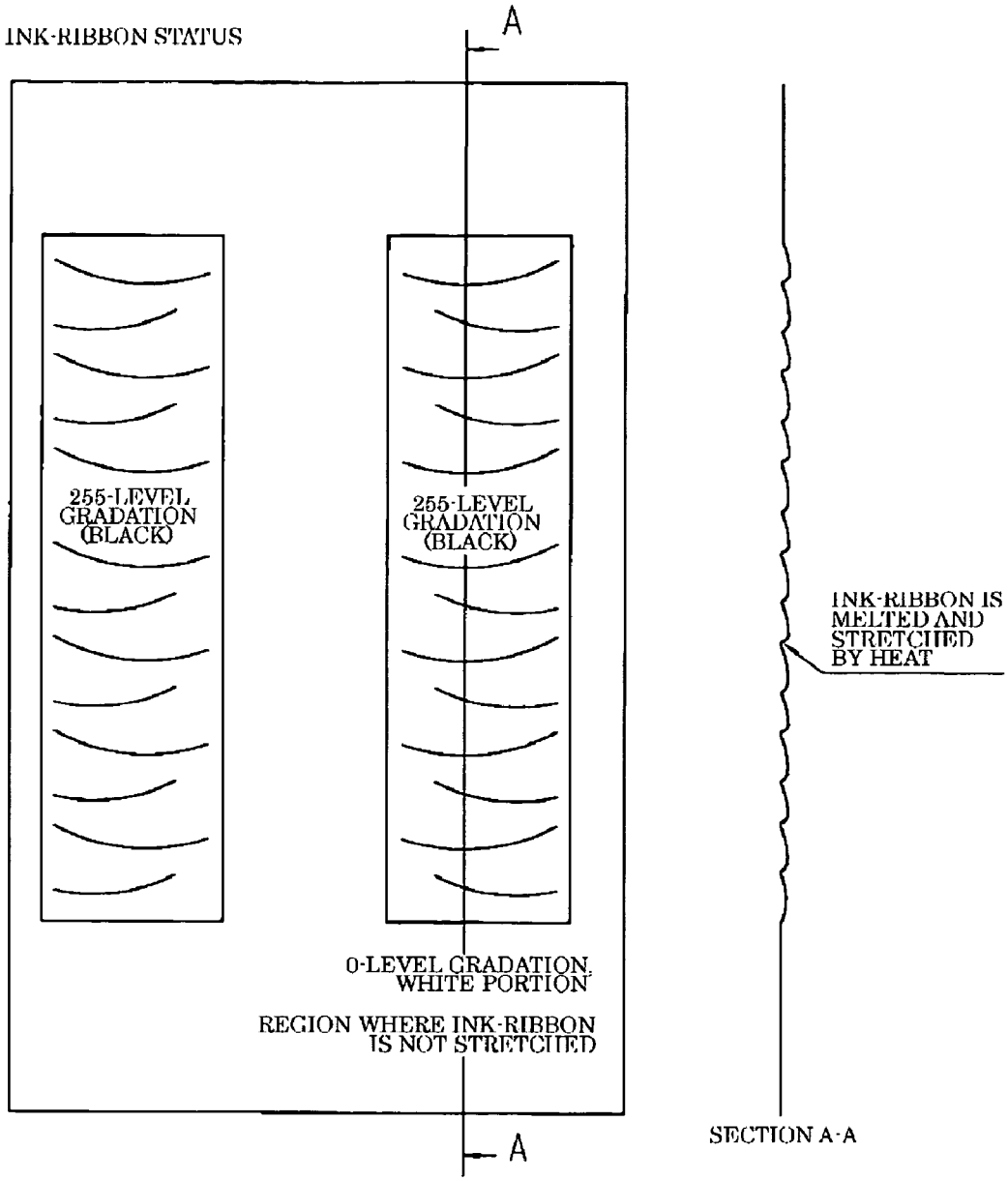
FIG. 5 is an explanatory view showing an ink-ribbon status after the print data of FIG. 4 is printed by the conventional thermal transfer type image recording apparatus.
Figure 6:
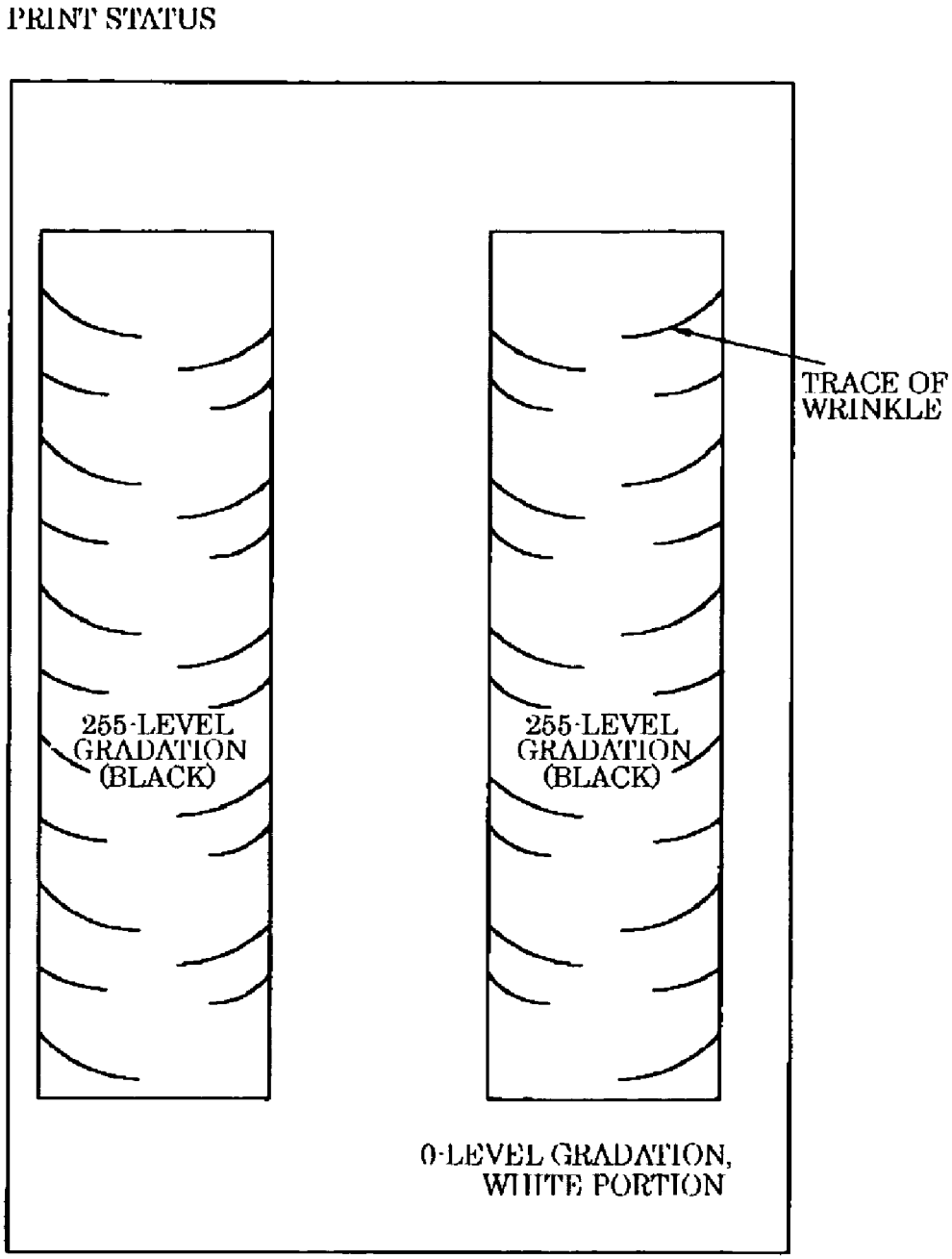
FIG. 6 is an explanatory view showing a print status printed by the conventional thermal transfer type image recording apparatus.
Figure 7:
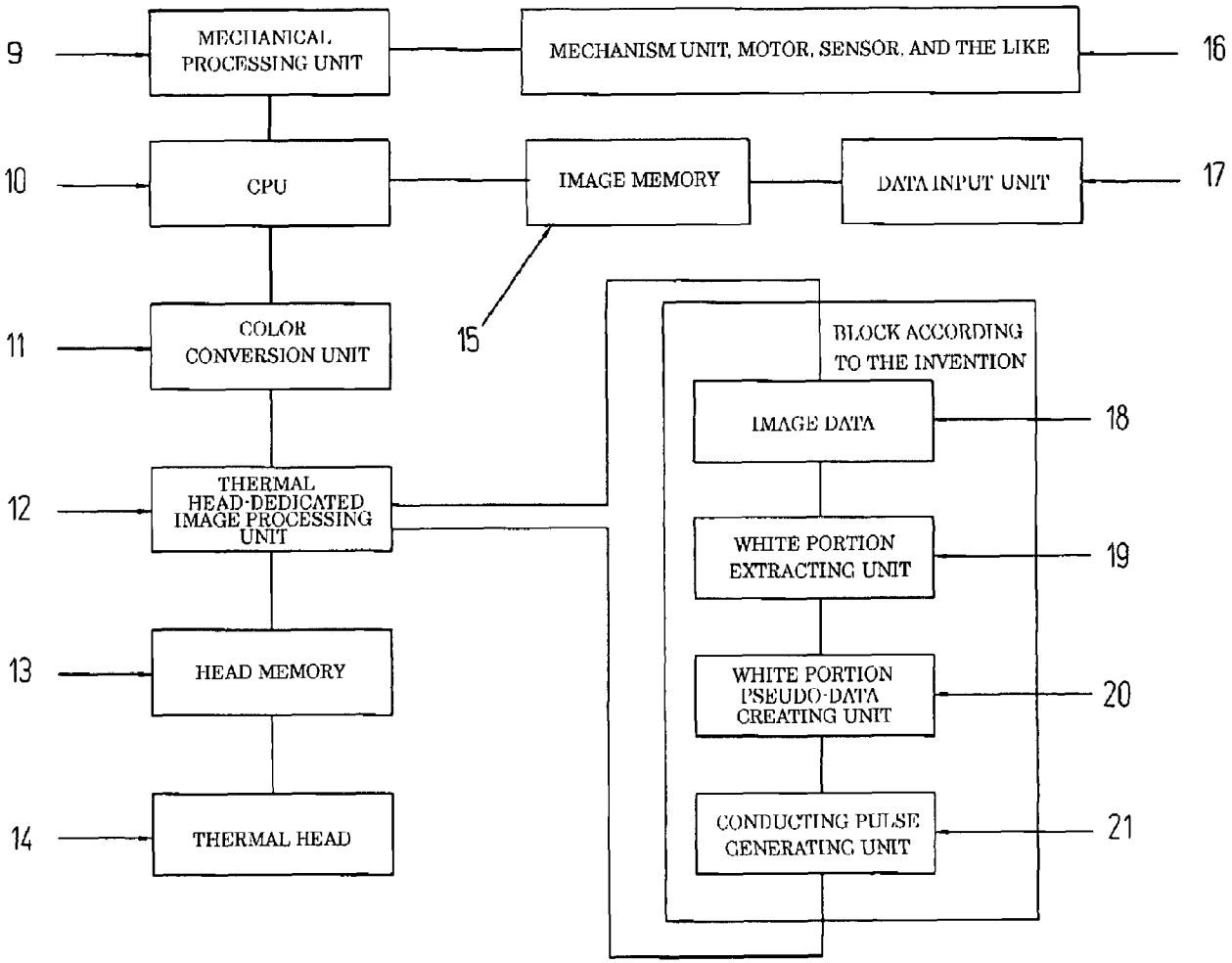
FIG. 7 is a block diagram showing a schematic configuration of the image recording apparatus of the invention.

FIG. 2 shows the conventional conducting method, and FIG. 3 shows a conducting method according to the invention. According to the conventional method of conducting the thermal head, the electric current is passed through the thermal head with energy according to the image data, because the coloring is not performed in the white portion in which the image data has the 0-level gradation, the conduction is not performed. On the contrary, the image recording apparatus according to the invention has the configuration as shown in FIG. 7. In the control method of the invention, conducting pulses of degree in which the coloring is not generated are generated according to the number of sub-scanning lines, and the conducting pulses are applied to the image-data portion of the 0-level gradation to which the conducting pulse is not applied in the conventional method while the conducting pulses have the highest energy in which the coloring is not generated.

Figure 8:
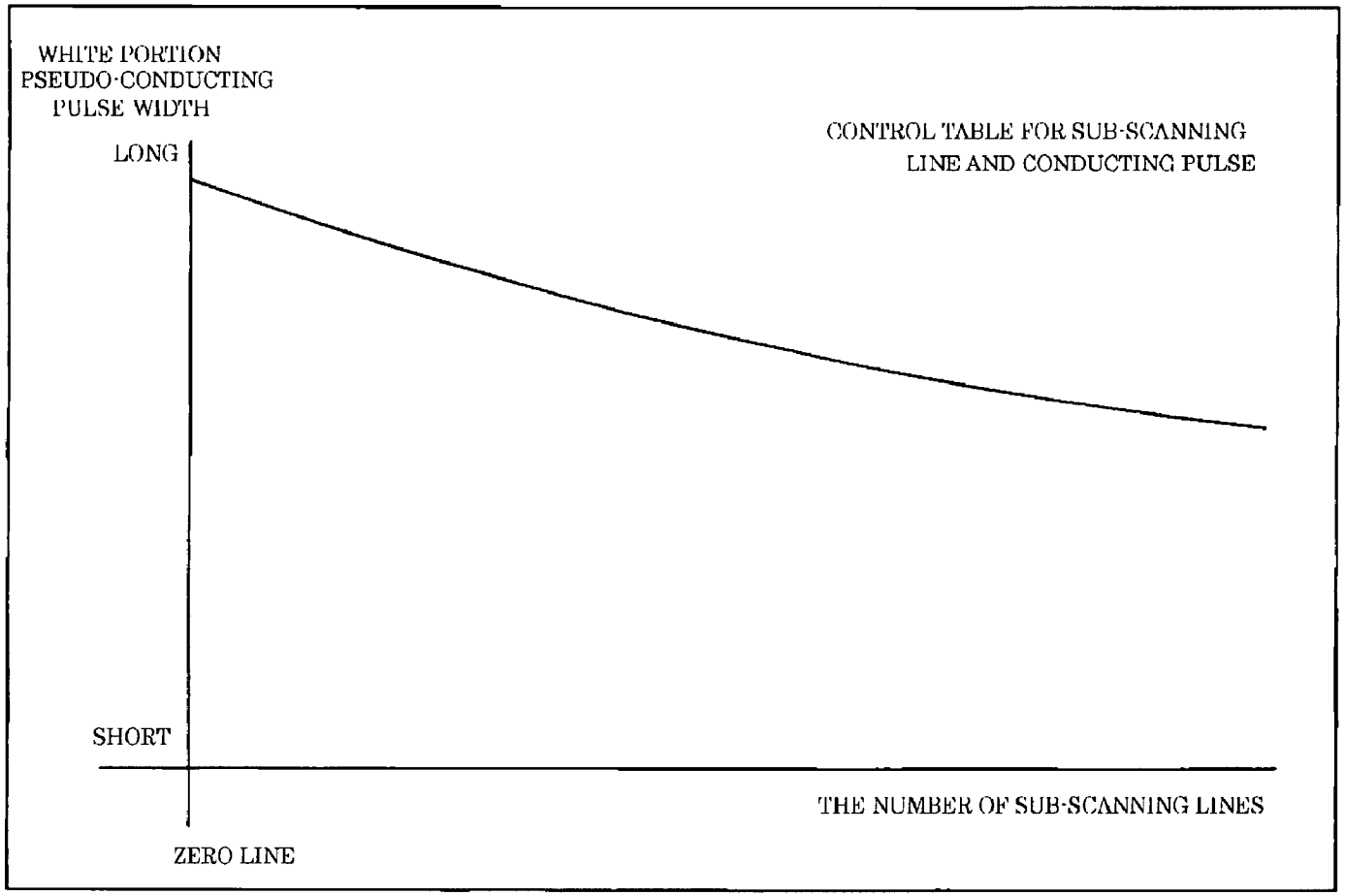
FIG. 8 is a graph showing a relationship between the number of sub-scanning lines and a conducting pulse width of a white portion in the invention.

In the invention, when the conducting pulse for the 0-level gradation portion in the image data is generated as shown in FIG. 3, pseudo-energy according to the number of lines in the sub-scanning direction is applied, the number of sub-scanning lines is added, and the energy is changed according to the addition of the number of sub-scanning lines. When the pseudo-pulse is not changed but fixed, because the temperature of the thermal head is increased, even if the energy is set below the coloring, the thermal head temperature is added to the conducting pulse energy to generate the coloring with the increase in temperature of the thermal head. However, as shown in FIG. 8, the conducting pulse in which the coloring is not generated can be optimized by performing the control in which the pulse is changed according to the number of sub-scanning lines, so that the coloring caused by the increase in temperature of the thermal head can be prevented, and the optimum energy can be supplied to the ink ribbon.

Figure 9:
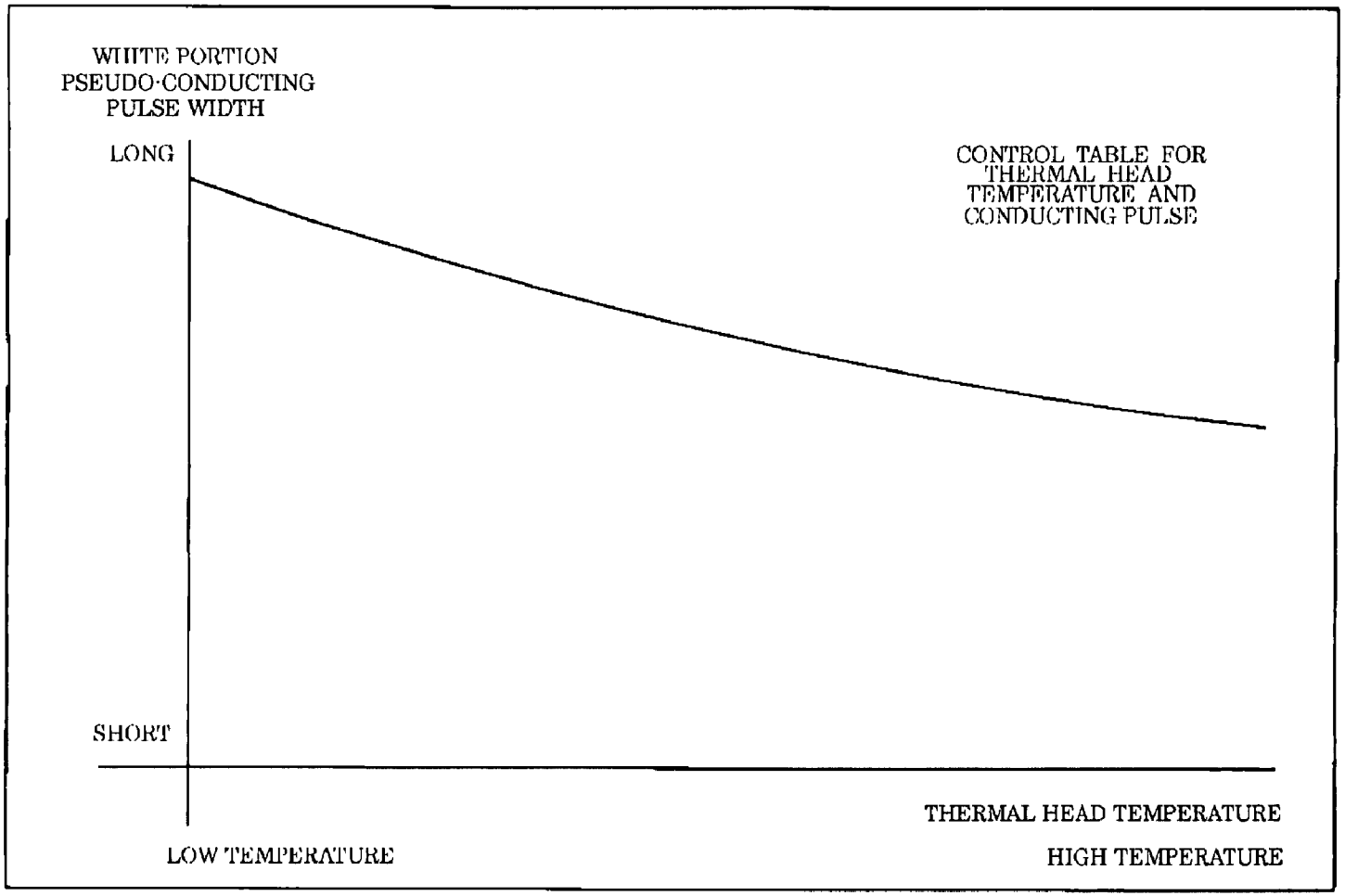
FIG. 9 is a graph showing a relationship between temperature change of a thermal head and the conducting pulse width of the white portion in the invention.

It is possible that the pseudo-pulse is controlled by a temperature sensor incorporated into the thermal head. It is possible that a measurement value of the temperature sensor is used as a control parameter. It is preferable to combine the measurement value of the temperature sensor and the control according to the number of sub-scanning lines. It is possible that correction is performed base on the temperature correction parameter as shown in FIG. 9.

It is possible that the conducting pulse of the white portion is not applied to all the area of white portions in the print area. Even if the conducting pulse of the white portion is applied to the area corresponding to at least 50% of the original white portion, the effect can be obtained by performing the conduction to the white portions adjacent to the data portions except for the white portion. During the control using the printer driver, when the portion in which the data does not exist in the original data, the image data in which the coloring is not generated is applied to the white portion by the application. Therefore, the same effect as for the pulse application shown in FIG. 3 can be obtained. Namely, the same effect can also be obtained by the application on the higher hierarchy side.

Figure 10:
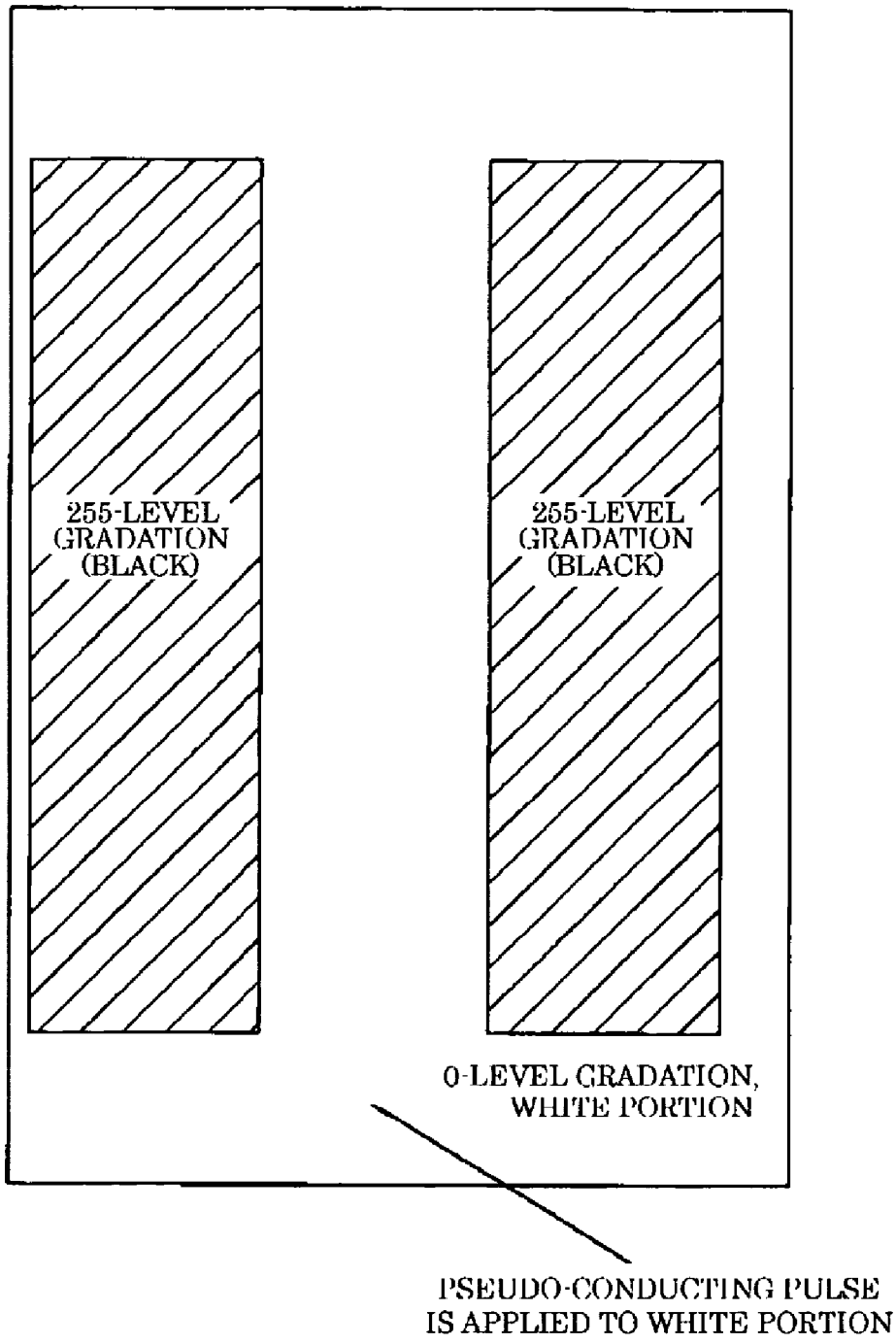
FIG. 10 is a view showing an effect of the invention to the print data of FIG. 1.

As described above, in the conducting pulse control of the invention, the image recording apparatus has the means for effectively controlling the application of the energy to the white portion in which the coloring is not generated in the print area. Namely, the energy is applied to the portion, in which the energy is not inputted as shown in FIG. 10, to the extent in which the coloring is not generated. Therefore, the even conducting pulses can be applied to the ink ribbon from the print start end to the terminal end by applying the optimum energy, and the highest energy in which the coloring is not generated can be stably inputted. As a result, since the conducting pulse is applied to the non-print portion in which the data does not exist, the conducting pulses are applied to the whole portions of the print area, which allows the distortion of the stretch to be reduced in the ink ribbon.

Figure 11:
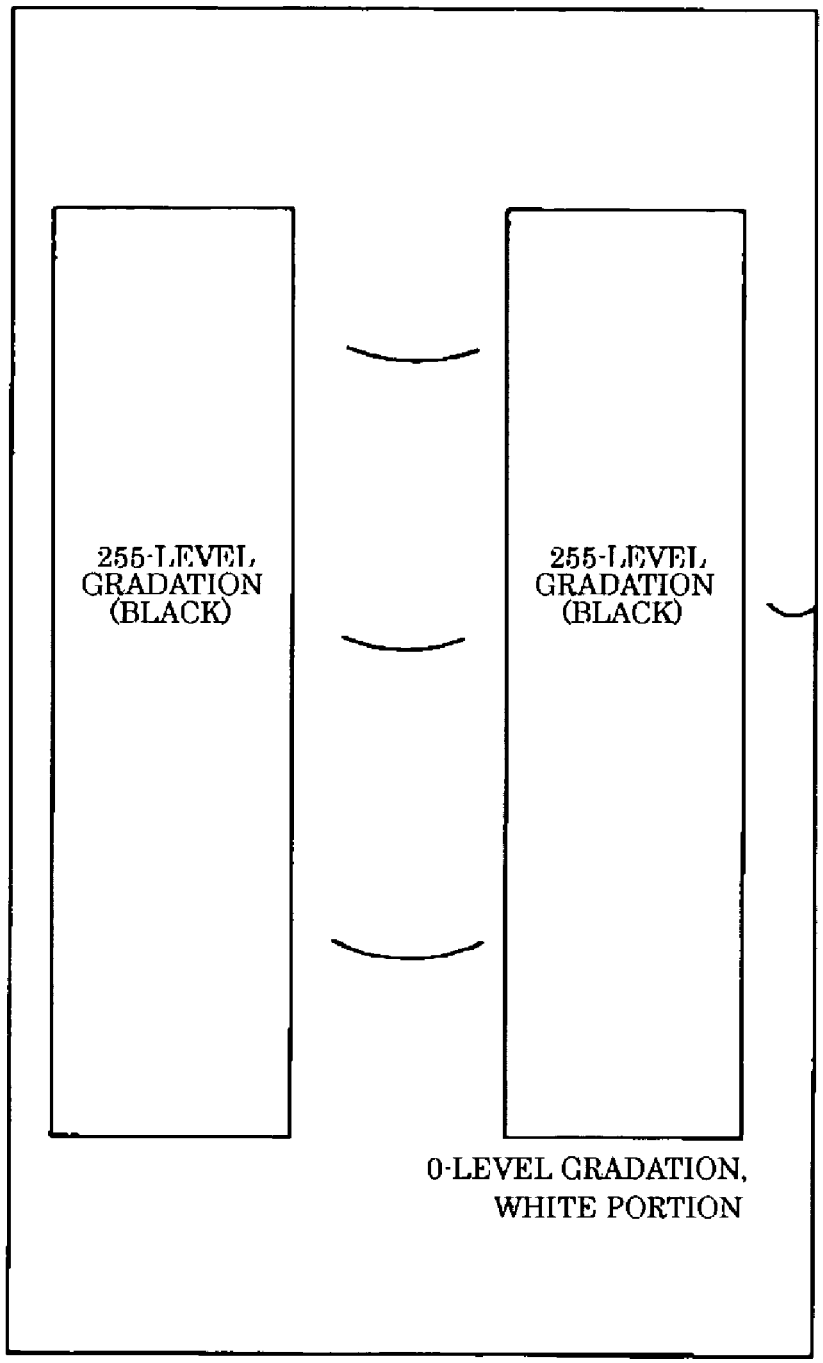
FIG. 11 is an explanatory view showing the ink-ribbon status in the invention.
Figure 12:
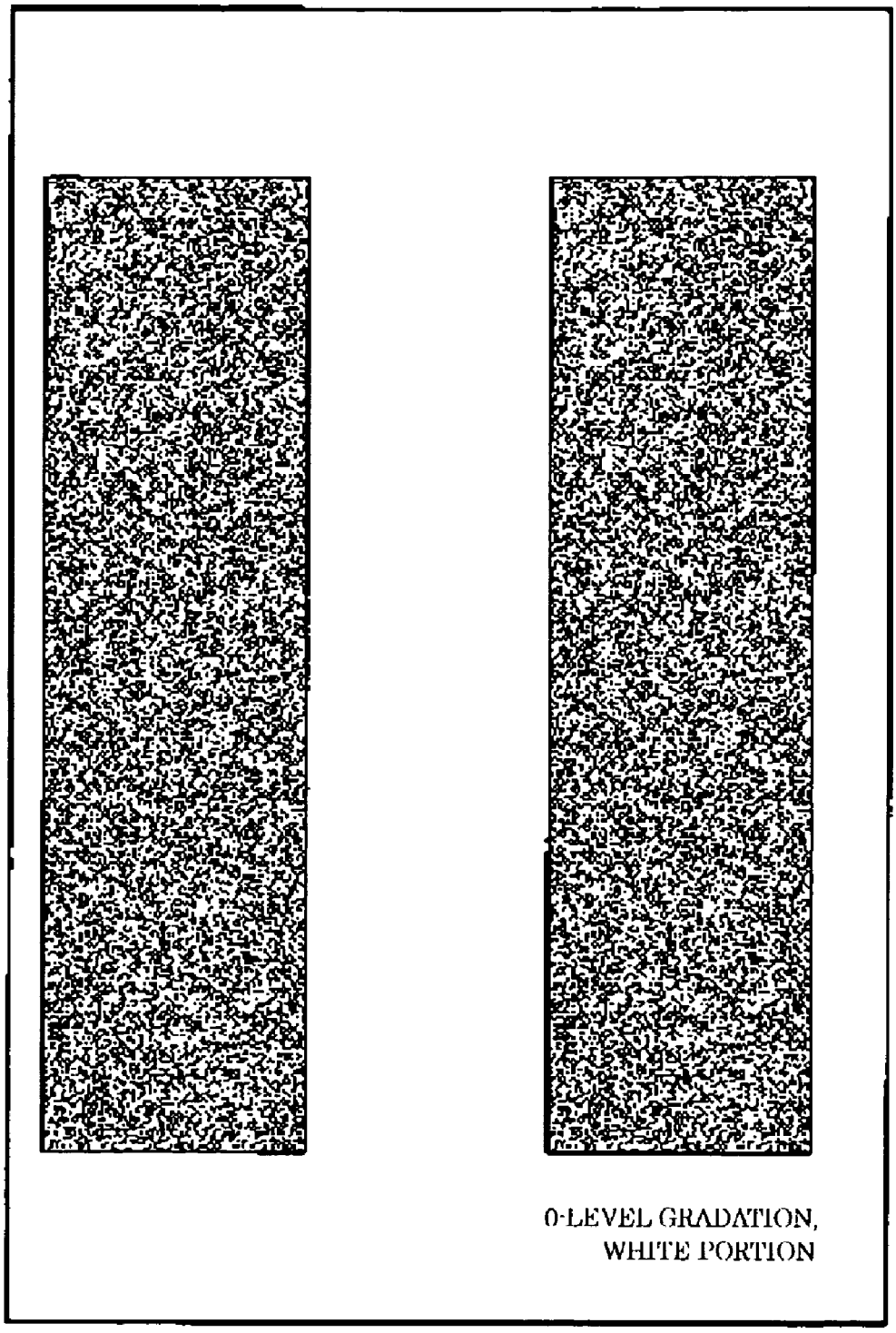
FIG. 12 is an explanatory view showing the print status in the invention.

FIG. 11 shows the stretch status when the energy is applied to the white portion by the conducting control method according to the invention. When the conducting pulses are inputted to the non-print portion, the difference in stretch between the coloring portion and the non-coloring portion in the ink ribbon can effectively eliminated, and the generation of the wrinkle caused by the difference in stretch can effectively suppressed. Therefore, the decrease in print quality caused by the wrinkle generation in the ink ribbon can be prevented, and the high-speed print to which the large energy is required can be realized.

What is claimed is:

1. In a thermal head conducting control method in an image recording apparatus which performs printing to a sheet-like recording medium with a thermal head, the thermal head conducting control apparatus comprising:

means for determining a non-printing portion in a print area by presence or absence of print data in the print area of the recording medium; and means for applying conducting pulses to the non-printing portion of the thermal head when the printing is performed to the recording medium, the conducting pulse having the maximum energy in which coloring is not generated.

2. A thermal head conducting control method in which conducting pulses are applied to a white portion in image data when printing is performed, the conducting pulse having a the maximum energy in which coloring is not generated by ink transfer, and the conducting pulses are controlled in a variable manner by controlling an energy with a predetermined parameter according to a number of sub-scanning lines.

3. A thermal head conducting control method in which conducting pulses are applied to a white portion in image data when printing is performed, the conducting pulse having a maximum energy in which coloring is not generated by ink transfer, and The conducting pulses are applied to at least a 50% area of the white portion in a print area.

* * * * *